US006557737B1

(12) United States Patent
Hanson

(10) Patent No.: US 6,557,737 B1
(45) Date of Patent: May 6, 2003

(54) PERSONAL INHALER CARRIER

(75) Inventor: Conniemarie Hanson, 1355 Payne Ave., St. Paul, MN (US) 55101

(73) Assignee: Conniemarie Hanson, St. Paul, MN (US)

( * ) Notice: Subject to any disclaimer, the term of this patent is extended or adjusted under 35 U.S.C. 154(b) by 0 days.

(21) Appl. No.: 09/708,389

(22) Filed: Nov. 9, 2000

Related U.S. Application Data

(60) Provisional application No. 60/167,318, filed on Nov. 24, 1999.

(51) Int. Cl.[7] ..... A45F 5/00

(52) U.S. Cl. ..... 224/148.6; 224/250; 224/237; 128/200.14; 128/205.22

(58) Field of Search ..... 224/148.4–148.7, 224/250, 255, 236, 237; D3/203, 215, 218, 225, 229; 128/200.14, 205.22

(56) References Cited

U.S. PATENT DOCUMENTS

| | | | | | |
|---|---|---|---|---|---|
| 4,838,466 | A | * | 6/1989 | Holmstrom | 224/250 |
| 4,881,684 | A | * | 11/1989 | Chinman | |
| 5,002,214 | A | * | 3/1991 | Caranci | 224/252 |
| D368,364 | S | * | 4/1996 | Reitano et al. | |
| 5,730,118 | A | * | 3/1998 | Hermanson | |
| 5,855,307 | A | * | 1/1999 | Biddick et al. | |
| 6,164,275 | A | * | 12/2000 | Van Iderstine | |
| 6,196,431 | B1 | * | 3/2001 | Underhill | 224/250 X |
| 6,330,430 | B1 | * | 12/2001 | Jensfelt | 224/250 X |

* cited by examiner

*Primary Examiner*—Nathan J. Newhouse

(57) ABSTRACT

A carrier for inhalant devices which are designed for personal usage which allows the inhalant to be easily attached to and carried by the user and which allows for operation of the inhalant without removing the same from the carrier. The carrier also selectively provides structure to removably attach a length of tubing thereto for directing the inhalant material from the inhalant device to the user's mouth as required.

6 Claims, 3 Drawing Sheets

PERSONAL INHALER CARRIER

RELATED APPLICATIONS

Applicant is not aware of any applications by others and has not personlly filed any applications for patent which should be considered during the prosecution of this application with the exception of an Application for Provisional patent which was filed on Nov. 24, 1999, Ser. No. 60/167,318, entitled Inhaler Holder.

SPONSORSHIP

This invention has been made through the sole efforts of the Applicant and was not made under any Federal nor any Independent Sponsorship or support.

BRIEF SUMMARY OF THE INVENTION

A carrier for a personal inhalant unit which releases inhalant upon the depression of one end of the unit. The carrier includes a strap for circumscribing the inhalant unit with straps for securing the unit about its ends to prevent its sliding from the circumferential strap. At least one of the end straps is flexible to permit shifting thereof to apply pressure to the inhalant unit to cause the unit to disperse medication therefrom without requiring removal of the inhalant unit from the carrier while the other end strap is shiftable to open the medicant dispensing end of the unit for administration of medicant from the carrier to the user.

The carrier includes, in a selectively available form, at least one additional strap structure to capture and removably retain an inhalant administration hose, tube or conduit for transmission of the medication from the unit, through the hose and to the mouth of the user.

The carrier may be provided with attachment means to allow for securing the same, along with the inhalant unit to the user's person.

BACKGROUND AND OBJECTS OF THE INVENTION

Many persons must, because of various medical conditions, carry an inhalant administration unit with them at all times. Losing or misplacing such units is a very common occurrence. There are and currently available of which Applicant is aware, inhalant unit carriers but these require that the inhalant unit be removed from the same. This separation of carrier from the inhalant unit often results in misplacing the unit.

With Applicant's invention, a carrier for an inhalant unit is provided which is attachable to the user's garments, purse or the like which permits use of the unit for adminstration of medication without removing the same from the carrier. If the carrier, through a lengthy attachment device to the user allows the unit to be positioned for administration of the medication, the unit and carrier are not necessarily even removed from the user's person. Further, Applicant's invention provides a carrier adjunct which will provide for carrying an administration tube or hose through which the medication is provided to the user.

It is therefore and object of the Applicant's invention to provide a personal inhalant carrier which allows the inhalant unit to be utilized without removing the same from the carrier.

It is a further object of the Applicant's invention to provide a personal inhalant carrier which, selectively, provides means for carrying an administration conduit for relatively remote utilization of the inhalant unit by the person requiring medication.

It is a further object of the Applicant's invention to provide a personal inhalant carrier that is universally adapted for usage with many inhalant units and provides for the interchange of the necessary replacement of elements of the inhalant unit should they become depleted and require renewal.

These and other objects and advantages of the Applicant's invention will more fully appear from a consideration of the following drawings and description;

DETAILED DESCRIPTION OF THE INVENTION

Figure 1:
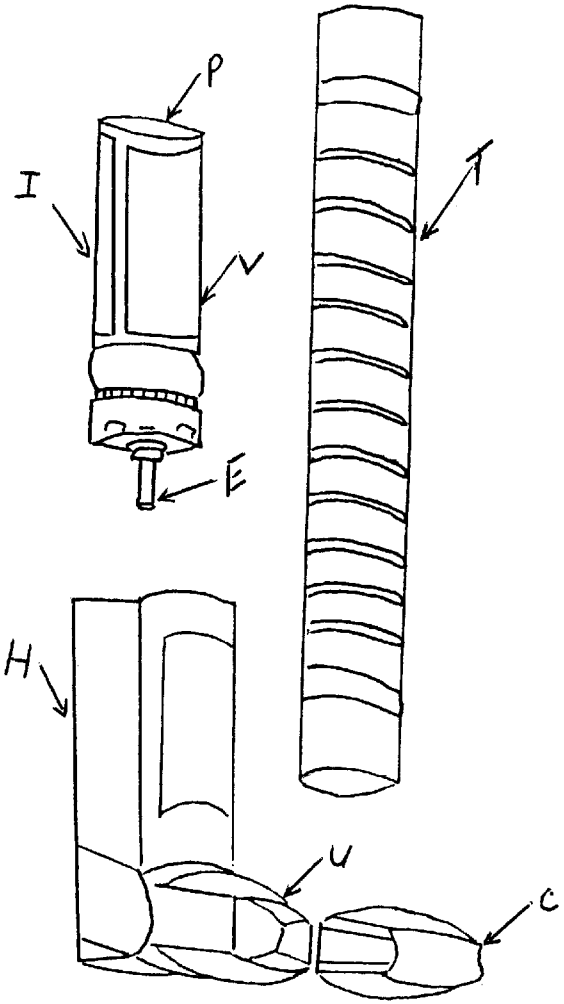
FIG. 1 is an illustration of the various elements that are normally provided for the administration of inhalants.

In accordance with the accompanying drawings, FIG. 1 illustrates the apparatus normally provided for a personal inhaler which is designated in its entirety 1 and is referred to hereinafter as "unit" or "inhaler unit". Such apparatus includes the inhalant containing vial V having a dispensing end E, usually in the form of a nozzle, and a pressure application end P; a vial housing H arranged to receive the vial V and having a trigger mechanism therein, not shown, which will open the dispensing end E of the vial V when pressure is exerted thereon by forcing the vial V into the housing H by pushing upon end P and cause medicant to spray from formed nozzle, user end U. User end U is, as illustrated, angularly and outwardly directed from housing H. These two elements will effectively release the mediant upon need by the user. Additional elements that are normally provided for use of the inhaler include a housing cover C to protect the user end U of the housing H and an administration tube T which may be attached, at one end to the user end U of the housing H with the other end being placed into the mouth of the user. This tube T allows for remotely locating the housing H and vial V from the user's mouth which, for example would allow the user to hang the carrier on their belt and still effectively use the inhaler.

Figure 3:
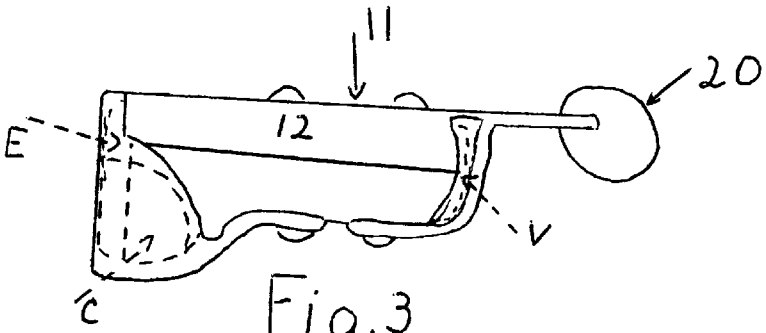
FIG. 3 is a side view of the unit as shown in FIG. 1.
Figure 2:
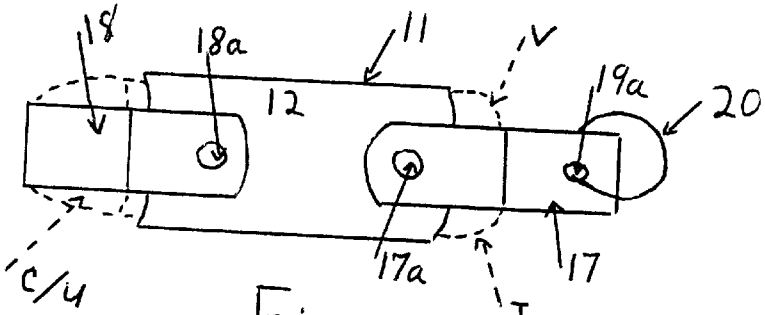
FIG. 2 is a front view of the inhalant unit carrier with the elements of the inhalant unit positioned therein being shown by dotted lines.
Figure 5:
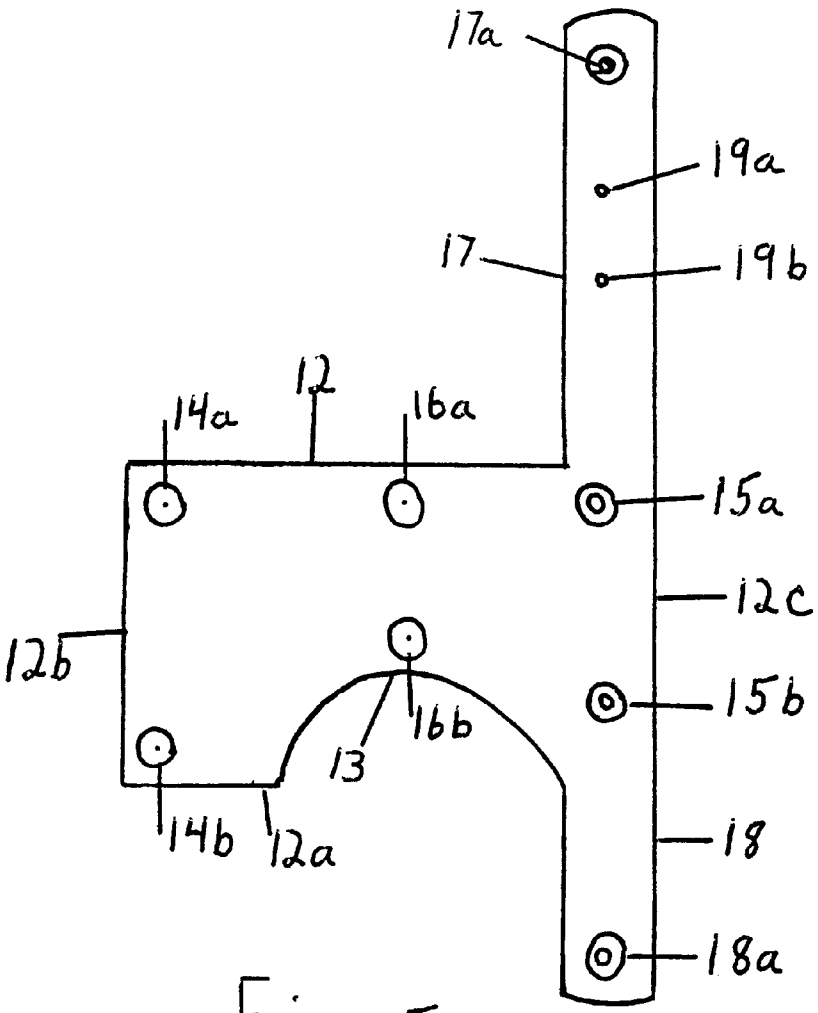
FIG. 5 is a layout view of the carrier portion of the invention illustrating snap fasteners therefore.

FIG. 2 illustrates the unit 1 within carrier 11. Carrier 11 includes a first housing H encircling or strap member 12 which, as illustrated in FIG. 5 is generally rectangular in shape with a circular cutout portion 13 arranged along one side 12*a* thereof such that when strap member 12 girds the housing H, the user end U and cover C will remain uncovered. When utilizing snap connectors as fastening means, a first end 12*b* of the encircling member 12 is provided with a pair of male or female snaps 14*a*, 14*b* and the second end 12*c* of the encircling member 12 is provided with a pair of opposed, male or female snaps 15*a*, 15*b*, the housing H is secured and completely surrounded by strap 12 with the user end and cover U/C extending.

It should be noted that two additional snaps 16*a*, 16*b* are provided on the strap 12 approximately midpoint of the circular 13 cutout portion and when the same encircles the housing H these snaps 16*a*, 16*b* will be outwardly directed.

In alignment with end 12*c* of strap 12 are extending straps 17, 18, each provided with snaps 17*a*, 18*a* at the ends thereof which will engage with snaps 16*a*, 16*b* and thus close over the end P and end U along with cover C of vial V. The longer of such straps 17 is provided, in this layout with apertures 19*a*, 19*b* which will align with each other when such strap 17 is folded upon itself to receive a carrying ring 20 or the like.

The invention, as described to this point, provides a complete carrying unit for an inhaler I which is retained therein through strap 12 and end straps 17, 18 and which may be conveniently secured to an article of clothing of the user through ring 20.

The material from which the straps 12, 17 and 18 is provided is substantially flexible such that, although properly maintaining the inhaler elements will permit opening of strap 18, removal of cover C from housing H and allow pressure to be exerted against pressure end P of the vial V to cause it to move against the internal trigger of housing H for release of medicant.

Figure 4:
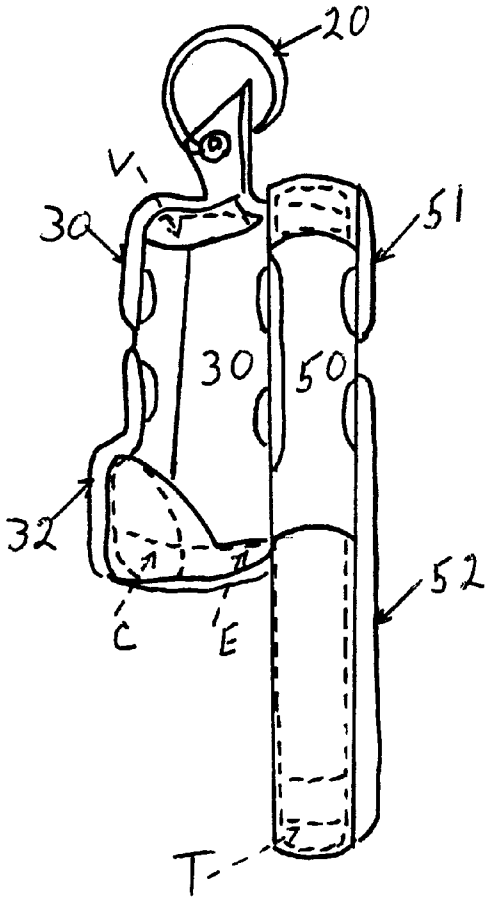
FIG. 4 is a side view of the unit, similar to FIG. 3 and including the carrier for the administration tube or conduit.
Figure 7:
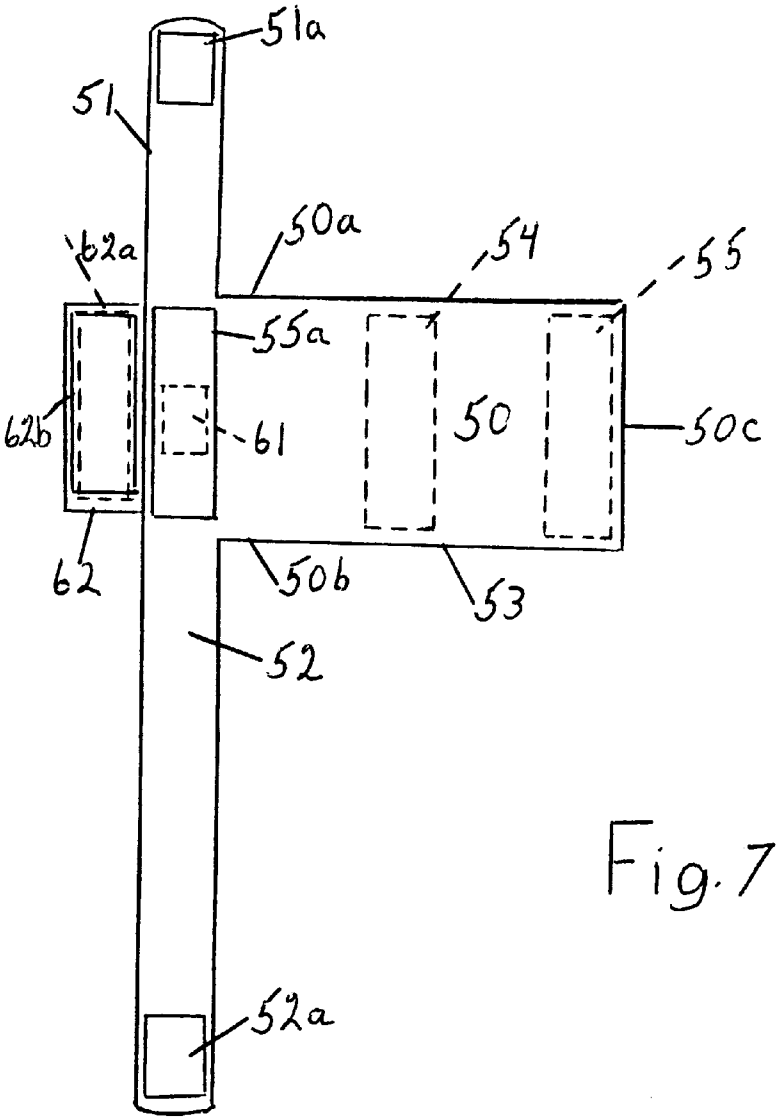

Applicant illustrates the primary invention, totally functional as described, with means for carrying the application or transmission tube T in FIG. 4 and to best describe the same, a description of FIG. 7 is necessary.

Reference is now made to FIG. 7 which illustrates a design for carrying a tube T although not illustrating connecting snaps and showing connection through hook loop fastener strips which would in placement of the snaps it being understood that such interchange does not alter the invention.

Figure 6:
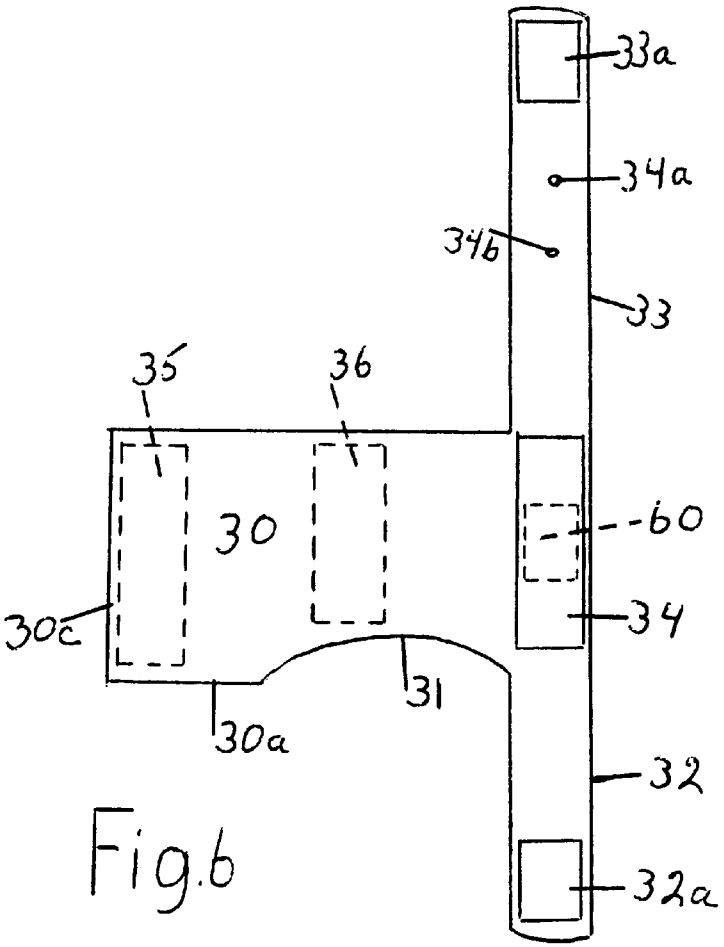
FIG. 6 is a layout of the carrier portion of the invention illustrating a second, hook loop fastener strip fastening arrangement; and, FIG. 7 is a layout of the hose or conduit carrying portion of the invention, again illustrating a hook loop fastener strip fastening arrangement.

The following description is pertinent to FIGS. 6 and 7 and will include the necessary variation at the conclusion thereof to describe the adaptation of the elements of FIG. 7 for use with the snap connector description.

FIG. 6 illustrates substantially the same structure as the housing H encircling strap of FIG. 5 in which a generally rectangular strap 30, provided with an inwardly directed circular cutout 31 along one side 30*a* thereof is provided with aligned straps 32, 33 arranged along one end 30*b* of strap 30. For fastening the straps 30, 32, 33 together strips of hook loop fastener, a mechanically enhanced face to face connector is utilized. A first strip of such material 34 is provided on adjacent side 30*a* of strap 30, face upwardly on the layout illustrated in FIG. 6 with a second strip 35 of such material arranged on adjacent side 30*c* of strap 30 and faces downwardly on the illustrated layout, thus the dotted lines illustrating the same. After strap 30 encircles the housing H, the strips 34, 35 are connected and the housing H is encircled. Strap 30 also includes an additional hook loop fastener strip 36, facing downwardly on the illustrated layout, to be outwardly exposed when strap 30 encircles the inhaler housing H.

Connective strips of hook loop fastener 32*a*, 33*a* are provided on straps 32, 33 and will, when folded over the inhaler unit I connect with strip 36 and overlie the ends P of vial V and the user end U and cover C of the unit I. Again, apertures 34*a*, 34*b* may be provided through strap 33 to accommodate a mounting ring.

When utilizing the tube or conduit carrying portion of the invention, the structure of FIG. 7 is provided. In FIG. 7 a separable assemble includes a rectangular strap 50 with supplemental straps 51, 52 extending from the sides 50*a*, 50*b* thereof a spaced distance from one end 50*c* thereof to result in a tab 62, strap 53 arrangement. As illustrated, tab 62 is provided with hook loop fastener strips, 62*a*,62*b* being designated, on both sides thereof such that one side will connect to hook loop fastener strip 34 of the article of FIG. 6 and will thus expose the other side thereof for connection to hook loop fastener strip 35 of the article of FIG. 6.

As shown, again in FIG. 7, strap 53 is provided with both an interim 54 and end 55 strip of hook loop fastener with, upon strap 53 encircling housing H strip 55 will connect with strip 55*a* to leave strip 54 exposed to connection with end strips 51*a*, 52*a* provided on straps 51, 52. Such straps 51, 52 will engage the ends of tube T while strap 53 will encircle the same.

To ensure that the unit, when housing both inhaler unit I and the tube T lie adjacent each other, additional hook loop fastener strips 60, 61 are provided on proper sides of the two units such that the combined unit will take the shape of the side view of FIG. 4.

In this tube T carrying illustration, the tube T will be removed from the end straps 51, 52 and may simply be slid through the girding strap 53 or such strap 53 may be opened. The strap 32 of FIG. 6 is then opened and cover C is removed from housing H. Tube T is connected to user end U of the housing H and pressure is applied against strap 33 to cause discharge of medicant.

Whether connective hook loop fastener is utilized, snaps are utilized or other connective devices are utilized, the concept of the primary carrier and primary carrier with tube carrying adjunct is the same. The primary concept is, as stated, to provide an inhaler carrier that does not require removal of the inhaler or inhalant unit from the carrier for use and as the adjunct concept a combined inhaler carrier and administration conduit carrier.

What is claimed is:

1. A personal inhaler carrier and a personal inhaler including a housing, the strap having a cutout portion to permit the user end of the housing to extend therethrough to receive an inhalant carrying and dispensing vial, the housing having a vial received end, an internal vial actuating member and an angularly and outwardly directed user end for emission of inhalant therefrom, the personal inhaler carrier including:

a. a first panel providing a housing strap member along one side thereof to encircle the housing, the end of said strap being removably attachable to said first panel to hold the housing;

b. a first and second set of straps extending respectively from two opposite sides of said panel and foldable over the user end and the vial receiving end of the housing and the contained dispensing vial having the respective ends thereof removably attachable to said first panel and removably retain the housing and vial within said first panel;

c. said strap covering the user end of the housing being of a length to cover the outwardly and angularly extending end of the user end; and, d. said strap covering the vial receiving end of the housing being of a flexible material whereby the, vial may be shifted within the housing to force the same onto the actuating member to dispense medicant from the vial through the user end.

2. The personal inhaler carrier as set forth in claim 1 and one of said first and second straps provided with an aperture therethrough to receive a connector device to secure the carrier to the user's person.

3. The personal inhaler carrier as set forth in claim 1 and said housing strap including snap fastener means for removably attaching the same to said panel.

4. The personal inhaler carrier as set forth in claim 1 and said housing strap including mechanical hook loop fastener means for removably attaching the same to said panel.

5. The personal inhaler carrier as set forth in claim 1 and means for removably securing a medicant transmitting conduit carrier to a select portion thereof.

6. The personal inhaler carrier as set forth in claim 5 and said medicant transmitting conduit carrier including:

a. means for releasably encircling a medicant transmitting conduit;

b. means for releasably retaining the respective ends of the conduit; and, c. means for releasably connecting said medicant transmitting conduit carrier to the inhaler carrier.

* * * * *